United States Patent [19]

Hubbard et al.

[11] Patent Number: 4,732,307

[45] Date of Patent: Mar. 22, 1988

[54] NAILING APPARATUS

[75] Inventors: Sidney C. Hubbard, 25228 La Loma Dr., Los Altos Hills, Calif. 94022; Gary M. Lass; Harold M. Lass, both of San Jose, Calif.

[73] Assignee: Sidney C. Hubbard, Redwood City, Calif.

[21] Appl. No.: 915,077

[22] Filed: Oct. 3, 1986

[51] Int. Cl.[4] ..... B25C 3/00

[52] U.S. Cl. ..... 227/7; 227/111

[58] Field of Search ..... 227/7, 8, 111

[56] References Cited

U.S. PATENT DOCUMENTS

| | | | |
|---|---|---|---|
| 3,771,708 | 11/1973 | De Nicola et al. | 227/111 |
| 3,796,365 | 3/1974 | Downing | 227/111 X |
| 3,935,983 | 2/1976 | Buttriss | 227/120 X |
| 3,972,462 | 8/1976 | Evans et al. | 227/111 |
| 3,984,040 | 10/1976 | Fry | 227/7 |
| 4,084,738 | 4/1978 | Schneider | 227/7 |
| 4,265,387 | 5/1981 | Strouse | 227/7 |
| 4,305,538 | 12/1981 | Schultz et al. | 227/111 X |
| 4,389,012 | 6/1983 | Grikis et al. | 227/120 |

*Primary Examiner*—Paul A. Bell

*Attorney, Agent, or Firm*—Flehr, Hohbach, Test, Albritton & Herbert

[57] ABSTRACT

A nailing apparatus in which a pair of guns are supported on a carriage in side-by-side relationship to permit nailing edges of adjacent panels with controlled nail spacing and penetration.

21 Claims, 14 Drawing Figures

NAILING APPARATUS

BACKGROUND OF THE INVENTION

This invention relates generally to nailing apparatus and more particularly to nailing apparatus in which portable nailing guns supported by a carriage are operated in response to movement of the carriage along the surface structure to be nailed.

Hand-held nailing guns are well known in the prior art. Operation of such guns requires that the operator carry the full weight of the relatively heavy nailing guns and bend over to engage the surface of be nailed.

Various nailing apparatus have been designed to reduce the physical labor associated with nailing a surface with a nailing gun. U.S. Pat. No. 3,796,365 provides a carriage which carries a portable nailing gun. Basically, there is provided a frame supported on a pair of rear wheels with a single front wheel. The frame includes an upwardly extending handle permitting the operator to move the carriage along the surface. The forward portion of the frame carries a pivotal bracket on which is removably mounted a pneumatically operated portable nailing gun actuated through a camming mechanism associated with one of the rear wheels.

U.S. Pat. No. 3,984,040 shows a deck nailing apparatus including a wheeled carriage for traversing a surface structure and a pair of spaced nail driving devices which are supported by the carriage in operative relationship to the surface. Control means are incorporated in the apparatus and coupled in controlled relationship with the nailing device to cause operation of the device in proportional relationship to the distance traversed by the apparatus. The control means comprises a cam wheel resiliently supported on the carriage to maintain rolling engagement with the surface traversed by the apparatus. The nailing guns are supported from outwardly extending arms.

There is a need for a nailing apparatus which can support a pair of guns in close side-by-side relationship to permit the nailing of the edges of adjacent panel sheets to a single underlying support joist or member. In most applications the nails must be driven to a precise depth with controlled spacing to pass building inspection and job engineer's requirements. There is, therefore, a need for a nailing apparatus in which the nail depth and spacing can be set and remain substantially fixed through a nailing job.

SUMMARY OF THE INVENTION

It is an object of the present invention to provide a nailing apparatus which reduces the time required to attach plywood sheeting to roof and floor structures and which minimizes operator fatigue.

It is another object of the present invention to provide an apparatus which permits driving nails or other fastening devices at the edges of abutting panels or sheathing panels to fasten the members to an underlying joist or support.

It is still a further object of the present invention to provide a nailing apparatus in which the penetration and spacing of the fastening devices or nails can be set to conform to job specifications and requirements.

It is still a further object of the present invention to provide a nailing apparatus which can be folded into a compact package for transport from job site to job site by one individual.

The foregoing and other objects of the invention are achieved by a nailing apparatus including a carriage having a plurality of wheels for supporting the carriage for movement on a work surface, a movable support arm for mounting at least one nailing device on said carriage for relative vertical movement with respect to the carriage so that the distance of the nailing head of said device above the surface to be nailed is maintained constant, a wheel carried by at least one said nailing device for engaging the surface and maintaining a consistent height of said nailing device above the surface, and means for controlling the actuation of the nailing device in response to movement of the carriage along the surface.

The foregoing and other objects of the invention will be more clearly understood from the following description taken in conjunction with the accompanying drawings.

DESCRIPTION OF PREFERRED EMBODIMENTS

Figure 1:
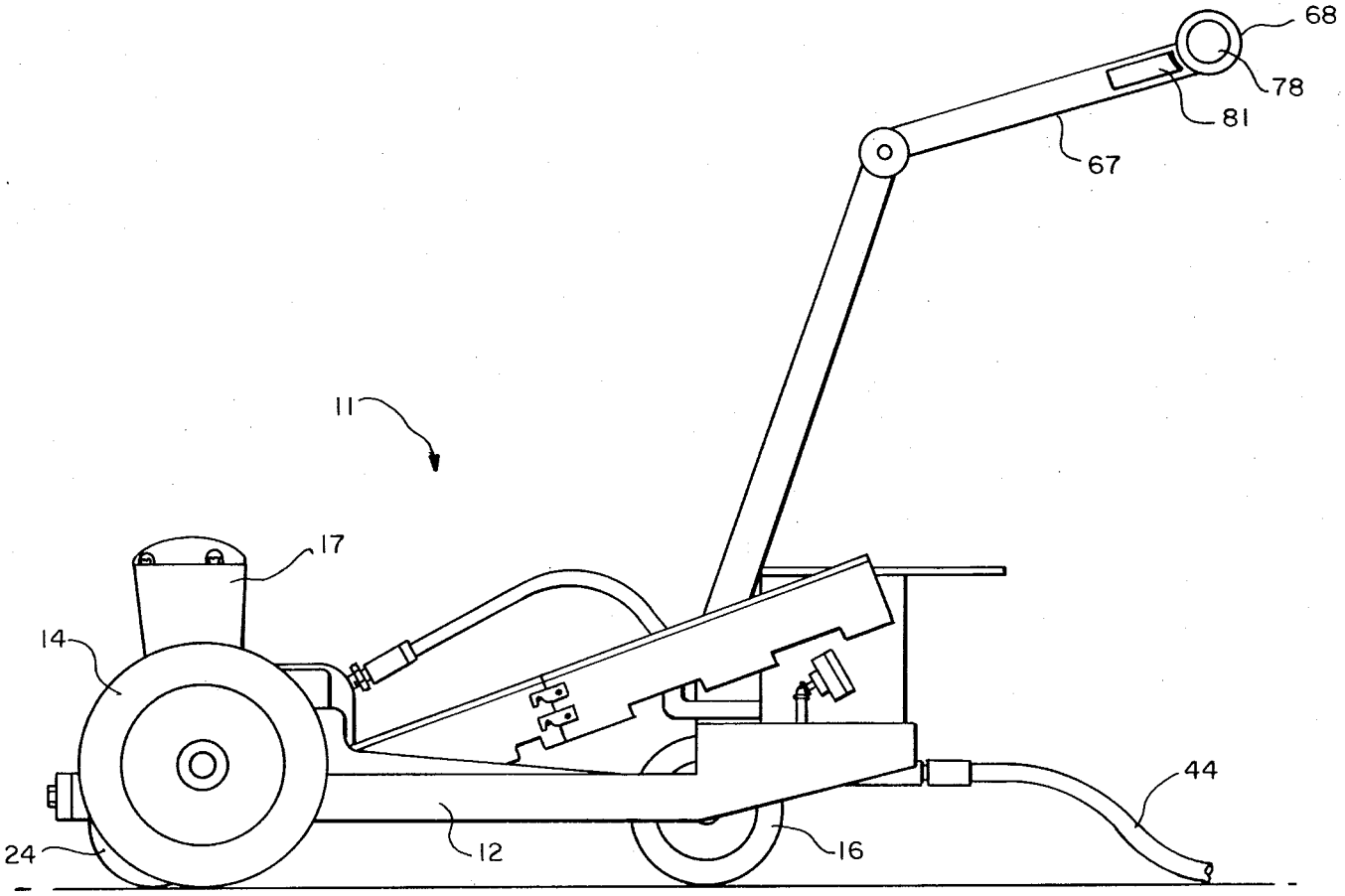
FIG. 1 is a side elevational view of a nailing apparatus in accordance with the present invention.
Figure 2:
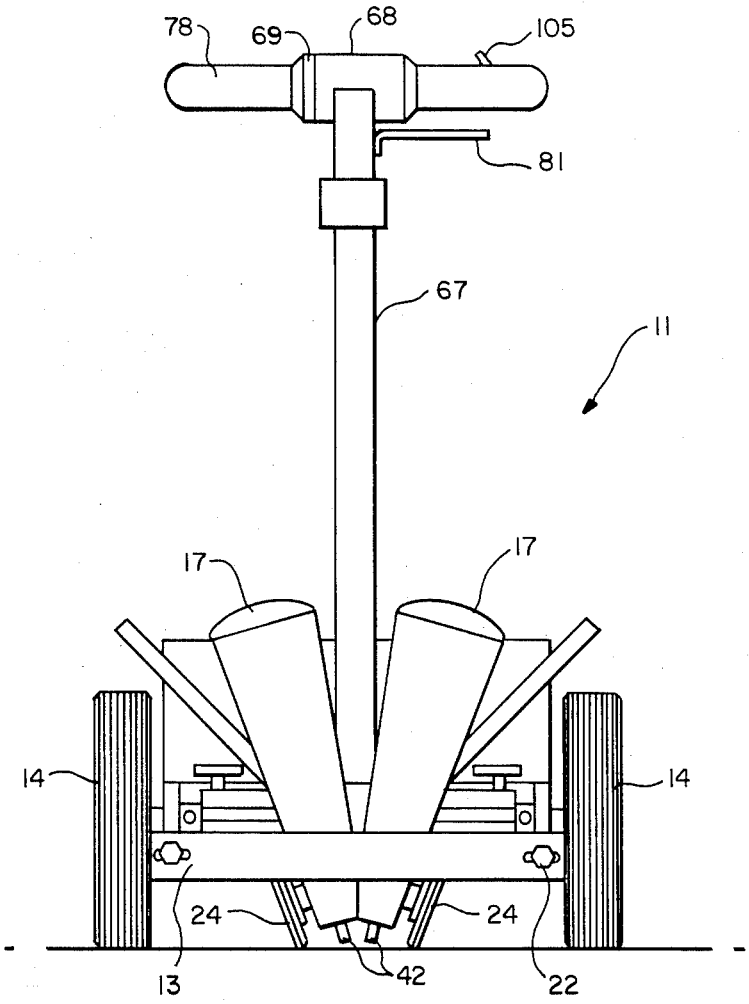
FIG. 2 is a front elevational view of the apparatus of FIG. 1.
Figure 3:
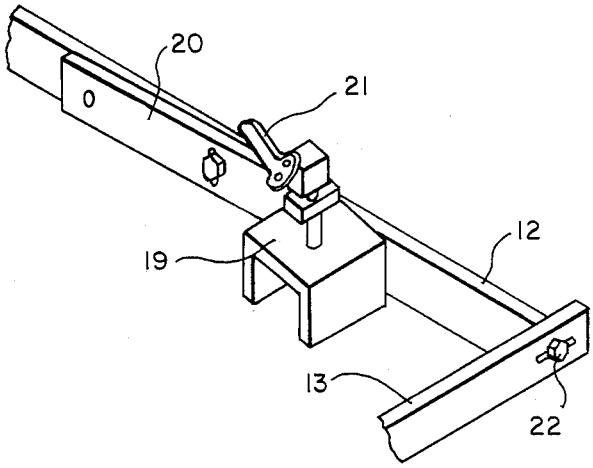
FIG. 3 shows the movable support arm for mounting the nail guns to the nailing apparatus carriage.

Referring to FIGS. 1 and 2, the nailing apparatus comprises a carriage 11 with a frame comprising parallel side rail members 12 and adjustable cross members 13. The frame is supported on a nailing surface by front wheels 14 and rear wheels 16 pivotally mounted so that direction of movement of the carriage can be controlled by the operator by moving the rear of the frame from side to side. In the preferred embodiment, spaced nailing guns 17 are carried on bracket 19 at the end of support arm 20 pivoted to the side rails 12 of the frame. This permits the nailing guns to move up and down to maintain a constant height from the surface and absorb the recoil as the guns are fired. The guns are mounted by engaging a quick release clamp 21 which is secured to the bracket 19.

The spacing between the guns can be adjusted by loosening the bolt 22 on the cross member and moving the side rail members. This adjustment provides for adjusting the edge nailing distance and in other circumstances to provide double rows of closely spaced nails.

Each of the nailing guns is provided with a wheel 24, FIGS. 1–5, which is adapted to engage the surface to be nailed and to support the guns with their nailing head a predetermined height above the surface.

Figure 4:
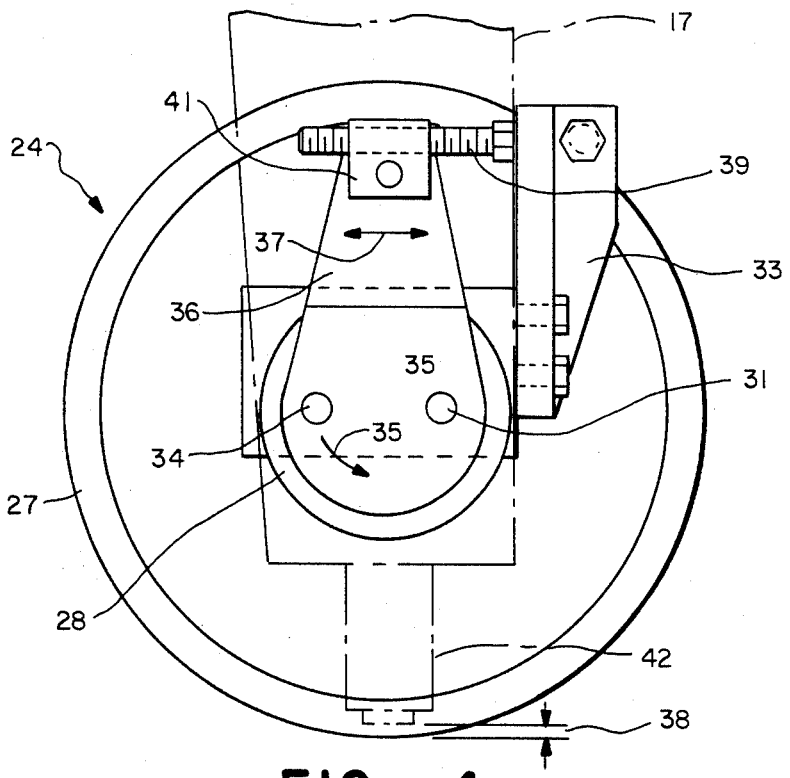
FIG. 4 is a side elevational view of the height adjustment assembly for controlling the heiht of the gun from the surface.
Figure 5:
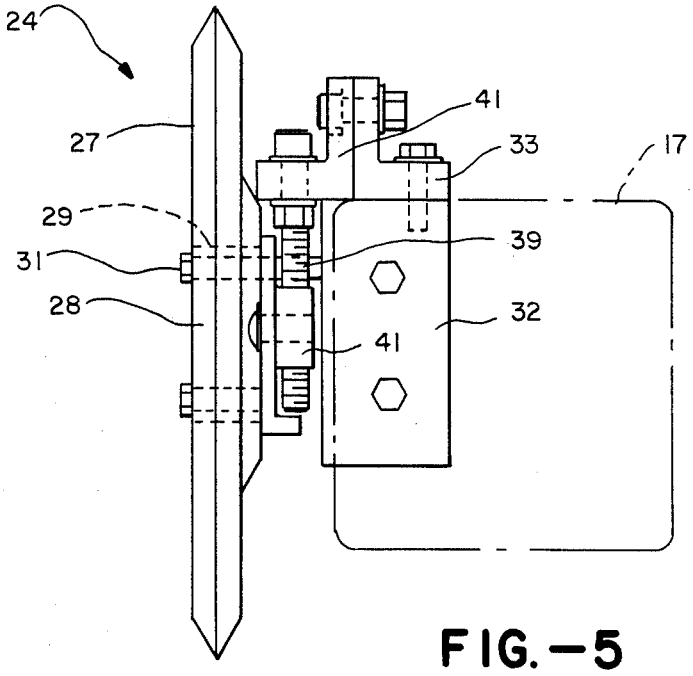
FIG. 5 is a front elevational view of the height adjustment wheel of FIG. 4.

Referring more particularly to FIGS. 4 and 5, the wheel comprises an outer V-shaped rim 27 and an inner hub 28 supporting the rim with bearings 29 permitting rotation of the rim with respect to the hub. The hub is secured to the nailing device by a suitable bolt 31 extending to bracket 32 secured to the associated gun. Bracket 33 is secured to bracket 32. A bolt 34 secures arm 36 to the hub. Movement of the arm 36 in the direction of the arrows 35 serves to pivot the hub about the bolt 31. This serves to raise and lower the wheel as illustrated by the arrows 38. The arm is rotated by means of a lead screw 39 which is threadably received by member 41 secured to the arm. Rotation of the lead screw serves to move the arm back and forth as shown at 37 and to lift and lower the wheel. The lead screw 39 is supported by a bracket 33.

Thus, the height of the nailing head 42 of the nailing gun above the surface is adjusted by the lead screw 39 and once fixed, remains substantially constant since as the carriage is moved across the nailing surface, the wheel 27 engages the surface and maintains the spacing of the head since the wheel will ride up and down on uneven surfaces to lift and lower the associated nailing gun to assure that there is a constant distance between the head and the surface to be nailed. This allows consistent penetration depth for the nails.

The nailing guns of the present invention are pneumatically operated from a source of high pressure air via the line 44, FIG. 1. In accordance with the present invention, the pneumatically operated and triggered guns are controlled by a pneumatic control system consisting of handle control valves for setting the nail spacing and selectively determining which or whether both guns are to be operated. In addition, there is a second control system which is cam operated and driven by a belt from one of the front wheels and which serves to determine when the apparatus has traversed a preset distance whereby to activate the nailing gun to nail at said selected spacing. Furthermore, the pneumatic system can be set to manually operate the nailing guns.

Figure 7:
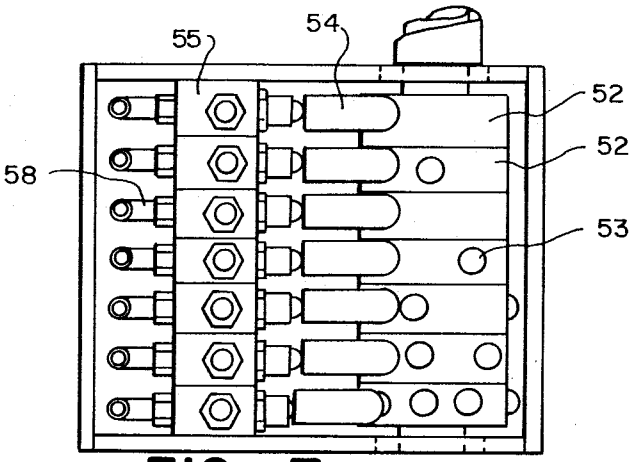
FIGS. 6–9 show the pneumatic nail spacing controller.

Referring particularly to FIGS. 6–9, the nail spacing camming apparatus is shown. The apparatus includes a cam travel control drum 51 which includes a plurality of discs 52, each carrying a different number of cam actuators 53. Referring to FIG. 7, it is seen that the lowermost disc includes more cam actuators 53 than the next adjacent disc, etc. Thus, if the first wheel is in control, the nail spacing will be relatively small since rotation of the cam wheel by the belt will cause the cams to engage the lever 54 a predetermined large number of times for each rotation. There is a cam lever 54 associated with each of the cam wheels. These levers actuate a valve 55. When actuated, the valve 55 connects the air supply manifold 57 via line 58 to the lines 61. Thus, as the machine moves forward, high pressure air is applied periodically to all of the lines 61 between valves 55 and the valves 62. In accordance with the present invention, one valve 62 will pass compressed air to the manifold 63 when compressed air is applied to its control line 64 which, as will be presently explained, is connected to the handle whereby the operator can select which one of the valves 62 of the plurality of valves will pass air to the manifold 63. Air from the manifold 63 travels outwardly to and triggers the associated gun.

Figure 9:
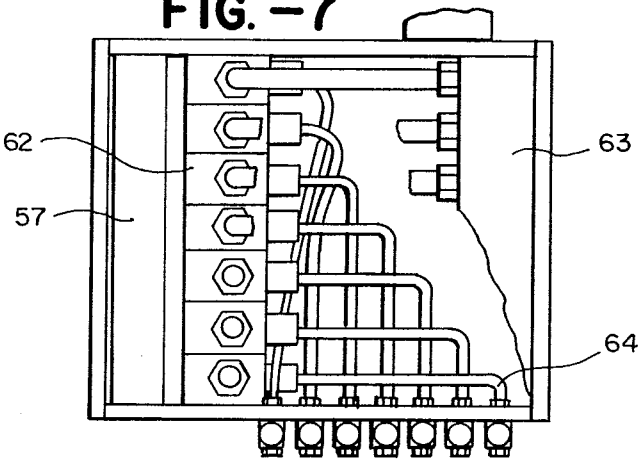
Figure 6:
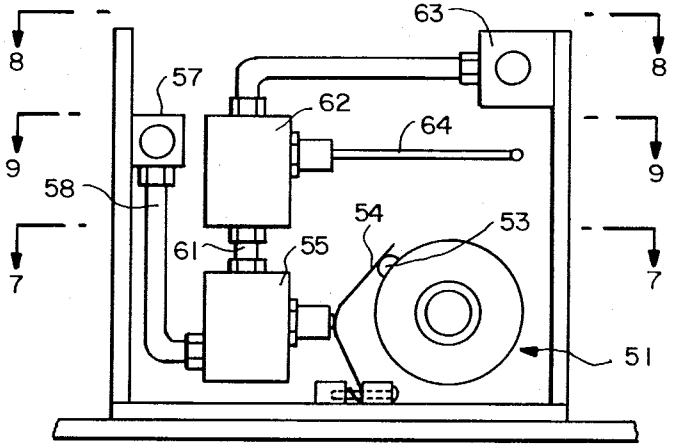
Figure 8:
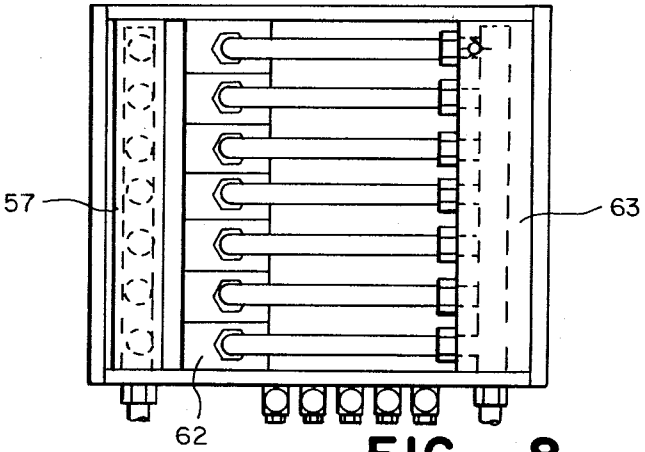

Thus, although all of the valves 55 are periodically activated and compressed air is supplied to the lines 61 between the valves 55 and 62, only that valve 62 which is actuated via a line 64 will pass air to the manifold 63 to trigger the corresponding gun. Thus, if, for example, the lowermost valve 62 in FIG. 9 is activated, then there will be a large number of nails driven by the nailing gun for a given distance of travel in view of the fact that the corresponding cam wheel contains a large number of cam members 53 for engagement of the associated cam arm 54.

Figure 10:
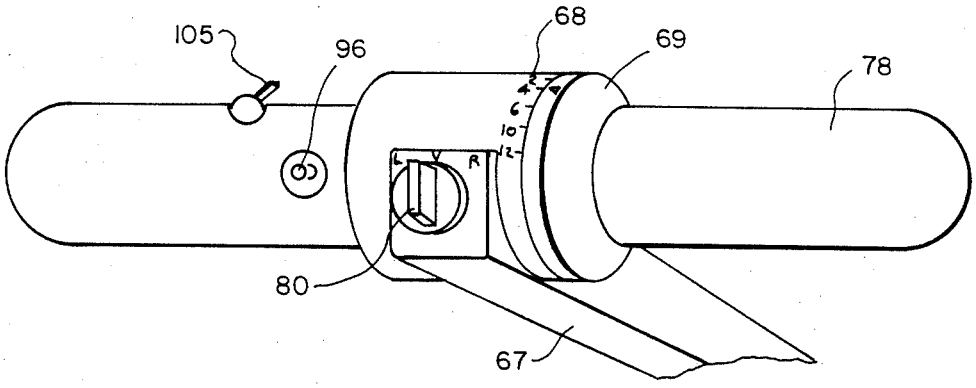
FIG. 10 is an enlarged view of the control handle.
Figure 11:
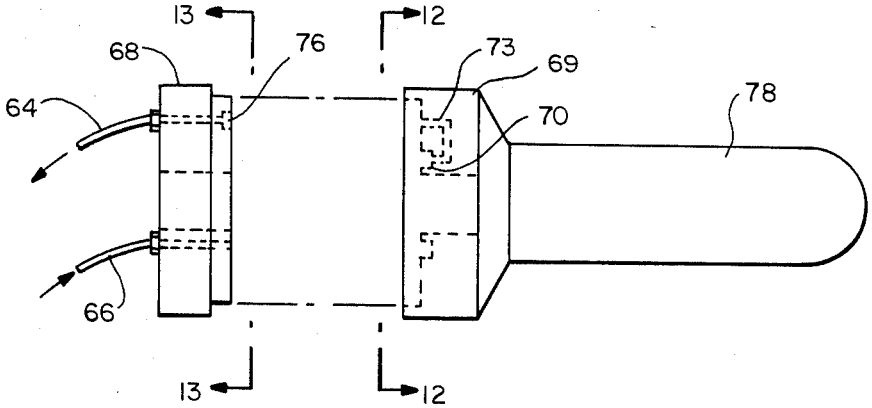
FIGS. 11, 12 and 13 show the pneumatic passages in the handle which serve to control nail spacing in response to rotation of the handle.
Figure 12:
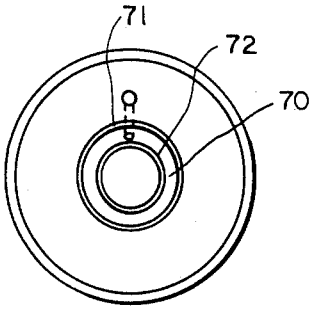
Figure 13:
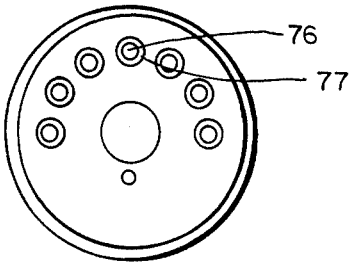

Referring now to FIGS. 10–13, the lines 64, as shown in FIG. 11, are selectively connected to the air supplied from line 66 by rotation of the right-hand handle 78. The compressed air line 66 extends up the handle 67 to the fixed member 68. The rotatable member 69 includes a circular groove 70 defined by concentric spaced O-rings 71 and 72. Thus, the compressed air fills the circular groove. A connecting conduit 73 rotates with the member 69 and serves to connect the compressed air to one of the lines 64 via the openings 76 surrounded by O-rings 77. Thus, as the handle 78 is rotated, the conduit 73 connects to one of the tubes 76 and thence to one of the lines 64 and then to the control valves 62 of the camming control. As seen in FIG. 10, the control can set a spacing of any desired amount; for example, 2, 2½, 3, 4, 6, 10 and 12 inches as shown.

There is a control 80 for selecting the right, left or both guns and a control switch 85 for selecting manual operation as will be explained in connection with the description of the pneumatic circuit of FIG. 14. The apparatus also includes a fail-safe switch 81 which is depressed by the operator during operation and, if released, turns off the nailing apparatus to prevent accidental firing of the nailing guns.

Figure 14:
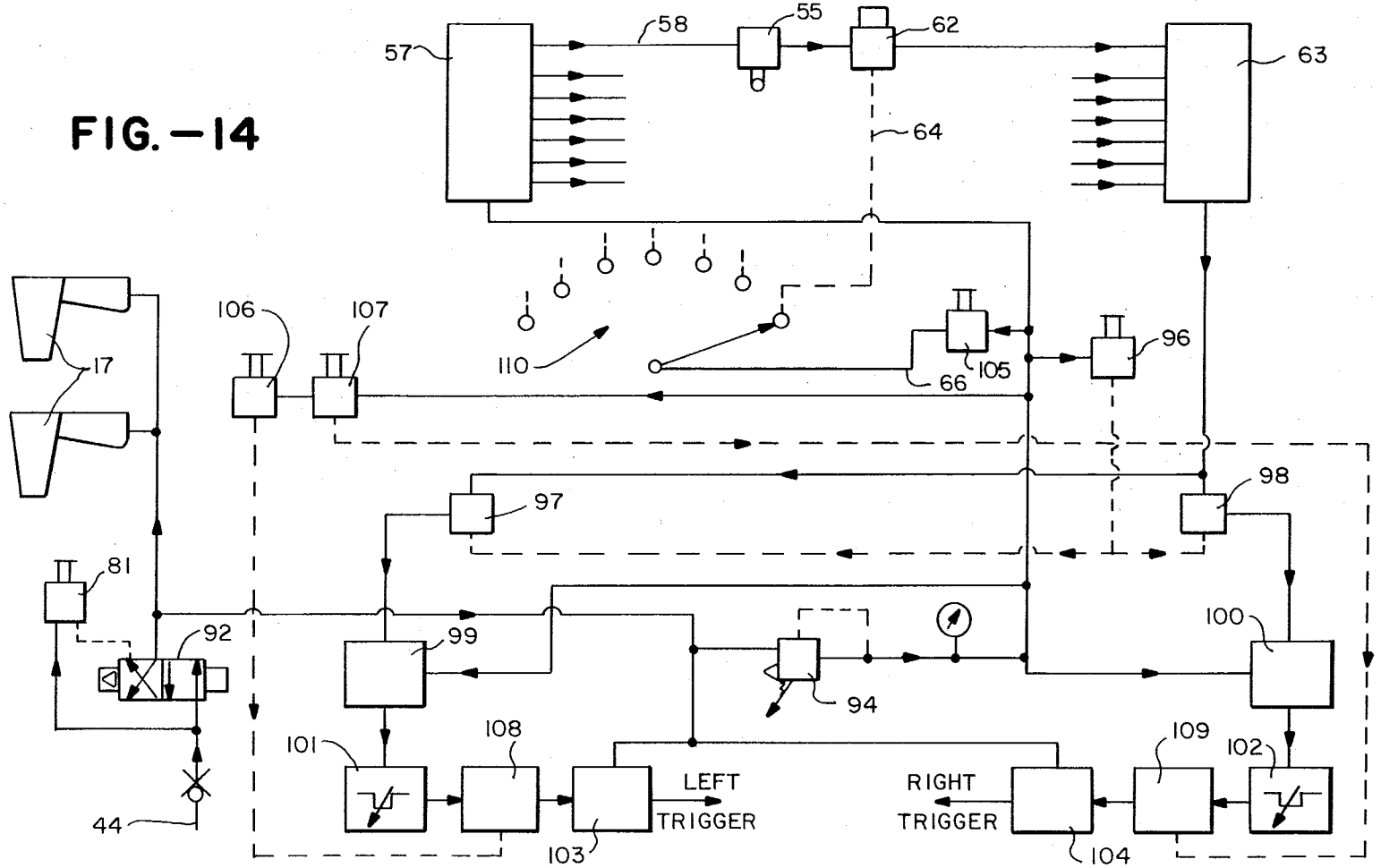
FIG. 14 is a schematic diagram showing the pneumatic controls for nail spacing control.

Referring now to FIG. 14 wherein line reference numerals have been applied to like parts, operation of the pneumatic circuit will now be described. Air from the compressor is applied to the line 44 via the valve 92 directly to the nailing guns and to the control system. The deadman switch or safety switch 81 controls the valve 92 whereby only when the switch is depressed does compressed air flow to the nailing guns and to the system. The air pressure for operating the control system is lower than the source compressed air at line 44. This is achieved by a regulator 94 connected in the line which supplies air to the control valves. The guns can be manually operated by the manual valve or trigger 96 which then supplies compressed air to the left and right shuttle valves 97, 98 to the AND gates 99, 100 to pulse timers 101, 102 which apply the full pressure compressed air to the left and right trigger valves 103 and 104 of the guns. The right-left gun controls 106 and 107 previously described are shown as controlling the AND valves 108, 109 whereby when pneumatic pressure is applied to the valves they pass pressure to the trigger valves 103, 104.

Valve 105 serves to control manual and automatic operation. It applies air to the cam selector handle line 66. The cam selector valves and cam selector are schematically shown at 110 as being connected to the line 66 and to the cam selector valve 62 via the line 64. The cam valves 55 are connected to the line 58 via supply manifold 57 and thence to the shuttle valve manifold 63. Operation of any one of the valves passes air through the shuttle valves 97, 98 to the AND gates 99, 100 to timing pulse valves 101, 102 and thence to the left and right trigger valves (pulse valves).

It should be apparent that rather than a pneumatic control circuit, the guns can be fired via an electric or electronic circuit having similar logic.

Thus, there has been provided a pneumatically operated nailing apparatus for nailing abutting members to common supports with controlled spacing and penetration of the nails.

What is claimed is:

1. A method for nailing a nailing surface comprised of panel members to an underlying joist or support structure using a nailing apparatus having a carriage with a nailing device mounted thereon, and a means for triggering the nailing device the method comprising the steps of:

passing the carriage along a seam to be nailed;

selecting a fixed carriage travel distance at which the nailing device will be automatically actuated in response to movement of the carriage along the nailing surface;

selecting a fixed height for the nailing device above the surface being nailed; and altering the selected nailing device height to control penetration of the nails into the panel members while operating the nailing apparatus.

2. A method as recited in claim 1 further comprising the step of manually triggering the nailing device in addition to the automatic travel distance responsive actuation to provide additional nails where required.

3. A method as recited in claim 1 further comprising the step of altering the selected fixed travel distance while operating the nailing apparatus.

4. A method as recited in claim 1 wherein the nailing apparatus includes a pair of nailing devices further comprising the step of adjusting the distance between the nailing devices to accommodate nailing a pair of adjoining panels to a common underlying support element.

5. A nailing apparatus including a carriage having a plurality of support wheels for supporting said carriage for movement on a surface, a nailing device having a nailing head, means for mounting said nailing device on said carriage, means for supporting the nailing device on said carriage for relative vertical movement with respect to the carriage so that the height of the nailing head of said device above the surface can be maintained, means mounted on said nailing device for engaging the surface for maintaining a constant height of said nailing device head from said surface, said constant height maintaining means including adjustment means for allowing the user to selectively adjust the height of said nailing device head above said surface, and means for selectively controlling actuation of said nailing device in response to movement of the carriage along the surface to provide a selected nail spacing.

6. A nailing apparatus as in claim 5 in which said means for selectively controlling actuation of the nailing device includes manual select means for selecting the nail spacing.

7. A nailing apparatus as recited in claim 5 wherein said means for selectively controlling actuation of the nailing device includes a control drum having a plurality of more than three disc regions carrying different numbers of cam lobes, means for rotating said control tube based on movement of the carriage along the surface, and selector means monitoring one of the disc regions for detecting the passage of its associated cam lobes and actuating the nailing device in response thereto.

8. A nailing apparatus as recited in claim 7, further comprising a handle extending rearwardly and upwardly from the carriage whereby an operator may move the carriage along the surface to be nailed, wherein said selector means includes a selector mounted on the handle for designating the disc region to be monitored.

9. A nailing apparatus as recited in claim 8, wherein each said disc region has an associated valve that is actuated in response to the passing of each said cam actuator and said selector directs pneumatic pressure to the valve associated with the selected disc region for actuating the nailing device.

10. A nailing apparatus as recited in claim 5, wherein said means for engaging the surface comprises:

a guide wheel, means for mounting the wheel on said nailing device, and means on said mounting means for raising and lowering the wheel with respect to the nailing device.

11. A nailing apparatus as recited in claim 10 wherein:

said wheel mounting means includes means for eccentrically pivotally mounting the guide wheel to said nailing device; and said raising and lowering means causes said guide wheel to pivot eccentrically.

12. A nailing apparatus including a carriage having a frame supported by a plurality of support wheels for supporting said carriage for movement on a surface, two nailing devices having nailing heads, means for mounting said nailing devices in side-by-side relationship on said carriage, means for supporting the nailing device on said frame for relative vertical movement with respect to the carriage so that the height of the nailing head of said device above the surface can be maintained, means mounted on each of said nailing devices for engaging the surface for maintaining a constant selectively adjustable height of said nailing device heads relative to said surface, said engaging means including adjustment means for allowing the user to selectively adjust the height of the nailing device heads relative to the surface, means on said frame for adjusting the lateral spacing between said nailing devices to adjust the lateral distance between nails delivered by the two nailing devices, and means for selectively controlling actuation of said nailing device in response to movement of the carriage along the surface.

13. A nailing apparatus as in claim 12 in which said means for engaging the surface includes a guide wheel, and said adjustment means is adapted for raising and lowering the wheel with respect to the nailing device.

14. A nailing apparatus as recited in claim 1 wherein:

said guide wheel is eccentrically pivotally mounted to said nailing device; and said attachment means causes said guide wheel to pivot eccentrically.

15. A nailing apparatus as recited in claim 14, wherein said engaging means further includes an arm eccentrically pivotally mounted to the guide wheel and said adjustment means includes a lead screw threadably connected to the arm for causing the guide wheel to pivot eccentrically about said arm.

16. A nailing apparatus including a carriage having a frame and a plurality of support wheels for supporting said frame for movement on a surface, a handle extending upwardly and rearwardly from said frame whereby an operator may move said carriage along a surface to be nailed, at least one nailing device having a nailing head, means for mounting said nailing device on said frame, means for supporting the nailing device on said frame for relative vertical movement with respect to the frame so that the height of the nailing head of said device above the surface can be maintained, means mounted on said nailing device for engaging the surface for maintaining a constant selectively adjustable distance between said nailing device head and said surface, said engaging means including adjustment means for allowing the user to selectively adjust the height of the nailing device head relative to the surface, means for controlling actuation of said nailing device in response to movement of the carriage along the surface, said controlling means including selectable means for actuating the guns responsive to different distances of movement, and means on said handle for selecting one of said selectable means to select the desired nail spacing.

17. A nailing apparatus as in claim 16 including means on said handle for selecting a manual mode of operation whereby nails are driven responsive to operator control.

18. A nailing apparatus as in claim 16 including fail-safe means on said handle whereby if the fail-safe means is released the nailing gun will not operate.

19. A nailing apparatus as in claim 16, including a pair of nailing devices mounted in side-by-side relationship and means on said frame for adjusting the spacing between devices, whereby the nailing devices may drive nails through adjacent panels into a common support beam.

20. A nailing apparatus as in claim 19 including means on said handle for selecting one or both of said guns.

21. A nailing apparatus including a carriage having a frame and a plurality of support wheels for supporting said frame for movement, a pair of nailing devices, means for mounting the pair of nailing devices in side-by-side relationship on said carriage with each said nailing device having a nailing head, means for supporting the nailing device on said frame for relative vertical movement with respect to the frame so that the height of the nailing head of said device above the surface can be maintained, adjustable means mounted on said nailing device for engaging the surface for maintaining a constant selectable height of said nailing device head from said surface, pneumatic means for actuating said nailing devices, and means for applying air to said pneumatic actuating means including pneumatic means responsive to movement of said carriage along the surface for applying bursts of air at intervals corresponding to selected distances of travel to thereby select the nail spacing.

* * * * *